United States Patent [19]

Webb

[11] Patent Number: 4,793,526

[45] Date of Patent: Dec. 27, 1988

[54] TOOTHPASTE PUMP

[75] Inventor: Ronald J. Webb, Baton Rouge, La.

[73] Assignee: Charles C. Garvey, Jr., New Orleans, La. ; a part interest

[21] Appl. No.: 55,987

[22] Filed: Jun. 1, 1987

[51] Int. Cl.[4] ..... B67D 5/42

[52] U.S. Cl. ..... 222/391; 222/392; 222/173

[58] Field of Search ..... 222/391, 392; 254/217, 254/218, 223

[56] References Cited

U.S. PATENT DOCUMENTS

| | | | |
|---|---|---|---|
| 876,968 | 1/1908 | James | 222/392 |
| 1,021,451 | 3/1972 | Craven | 222/392 |
| 3,220,616 | 11/1965 | Jennings | 222/392 |
| 3,774,809 | 6/1987 | Bratton | 222/392 |

*Primary Examiner*—H. Grant Skaggs

*Attorney, Agent, or Firm*—Pravel, Gambrell, Hewitt, Kimball & Krieger

[57] ABSTRACT

A paste dispenser comprising an elongated tubular body having a central bore for containing a paste product therein with a dispensing outlet positioned at one end portion of the tube, a follower plate movably disposed within the bore of the tubular body at one end portion thereof, defining an end portion for containing paste contained within the tube. The initial position of the plate is at an opposite end of the tube from the outlet when the tube is filled with paste, a transverse plate is positioned at the end portion of the tubular body adjacent the outlet, and a rotatable drum is mounted on the tubular body at the transverse plate. A pivotally moving support is mounted at one end portion of the tubular body providing a gripping surface which can be manually forced to move the pivot between first and second positions, and a biasing spring for urging the pivot to assume the first position combines with a ratchet for urging a rotation of the drum in one rotational direction. An elongated length of cable is attached at one end portion to the follower plate and at its other end portion to the drum so that rotation of the drum winds the cable thereupon, applying tension to the cable for urging the follower plate towards the transverse plate to dispense product via the outlet.

6 Claims, 2 Drawing Sheets

TOOTHPASTE PUMP

BACKGROUND OF THE INVENTION

The present invention relates to dispensing devices for dispensing paste-like products such as toothpaste and the like. More particularly, the present invention relates to an improved tube dispenser for toothpaste and other paste-like products using an outer, rigid elongated hollow tube with a follower plate that is moved longitudinally by a finger or thumb operated winch or reel. Pressure applied by the winch cable to the follower plate forces a paste product through a dispensing nozzle. Even more particularly, the present invention relates to an improved mechanism for rigid, hollow tube containers for dispensing toothpaste wherein a rotary drum winds an elongated monofilament flexible cable upon the reel in order to apply tension to a follower plate which urges toothpaste or the paste product through the dispensing outlet of the tube.

Recently, a number of manufacturers have sold toothpaste and other paste-like products in rigid tubes having thumb operated dispensing outlets at one end portion. These devices generally employ an elongated hollow rigid tube having a folower plate on the inside. The follower plate is initially positioned at the bottom when the tube is full. The follower plate defines the lower limit of the contents of the paste within the tube. By applying pressure to the follower plate causing it to ascend in the tube, the toothpaste or like product is forced upwardly and out through a dispensing outlet. The follower plate must be somewhat flexible in order to form a good seal with the inside wall of the tube. Normally, a plastic or rubber material is used in the follower plate construction. Some of these devices use an elongated rod which is notched and which attaches to the follower plate at multiple teeth that are unidirectional in that the rod can only travel through the teeth in one direction. The direction of follower plate travel causes the follower plate to compress the paste and force the contents from the tube. Such toothed devices require knife-like edges of strength and durability that necessarily require the use of a metallic substances, such as stainless steel or the like.

The use of such a composite construction increases the complexity and cost of the apparatus raising the eventual cost to the consumer. A composite metallic-plastic construction increases costs of assembly.

SUMMARY OF THE INVENTION

The present invention provides a simplified, improved rigid tube type paste dispenser that has a follower plate wherein the follower plate is moved to compress the paste and force it out of the tube. Thus, advantages of the present invention over prior art type toothpaste pumps are (1) a total of fewer working parts; and (2) a more complete displacement of the product is achieved.

The present invention includes an elongated tube for containing paste and a reel or winch with a ratchet mechanism which reels up a follower plate or plunger. The winch includes teeth which are turned by a tooth on a pump handle. The pump handle is cast onto the body of the tube and is snapped into the winch by use of inclined surfaces. The follower plate or plunger is assembled with a plastic monofilament string molded onto it. A funnel could be used to guide the cable through the winch. The ratchet portion of the winch operates when the handle is depressed, moving the tooth in a downward motion engaging the teeth which override the tooth on the handle. Springs return the handle to set the original position.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 2:
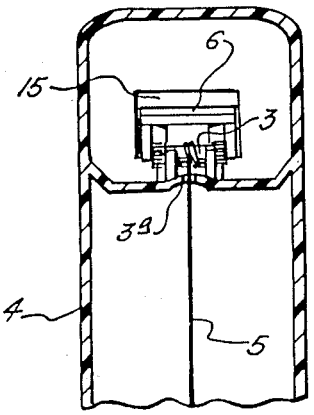
FIG. 2 is a fragmentary, sectional view of the preferred embodiment of the apparatus of the present invention illustrating the dispensing end portion thereof.
Figure 2:
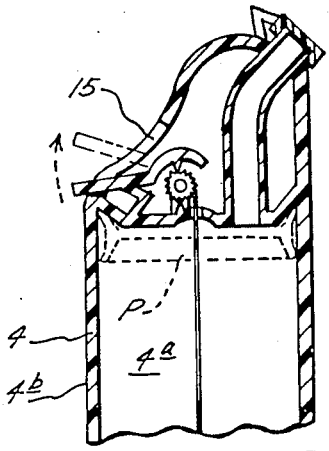
Figure 1:
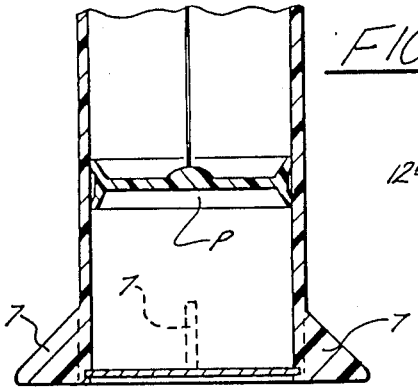
FIG. 1 is a sectional view of the preferred embodiment of the apparatus of the present invention.
Figure 3:
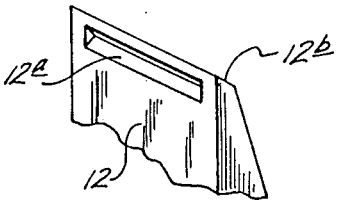
FIG. 3 is a fragmentary view of the preferred embodiment of the apparatus of the present invention illustrating a partial view of the ratchet mechanism thereof.
Figure 4:
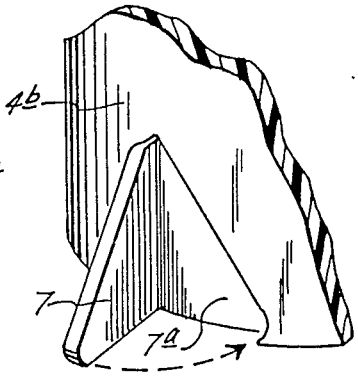
FIG. 4 is a partial fragmentary, perspective view of the preferred embodiment of the apparatus of the present invention illustrating the base portion thereof.
Figure 5:
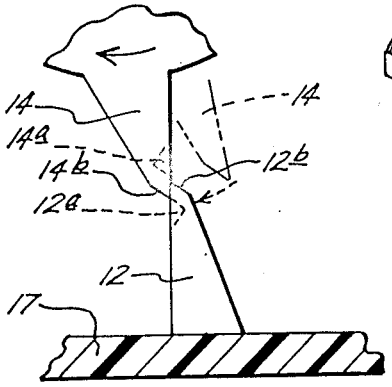
FIG. 5 is a fragmentary, elevational view of the preferred embodiment of the apparatus of the present invention illustrating the ratchet portion thereof.
Figure 6:
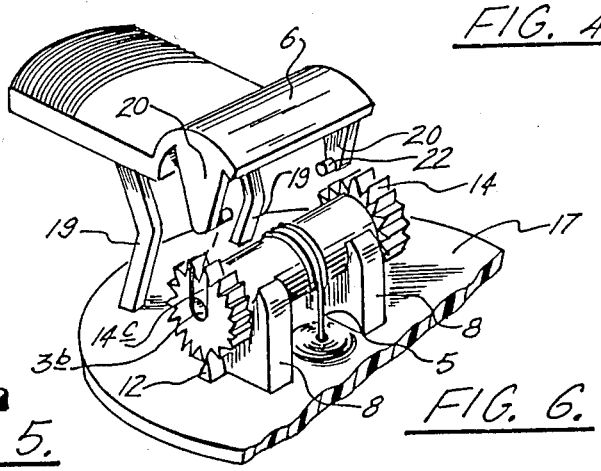
FIG. 6 is partial perspective view of the preferred embodiment of the apparatus of the present invention illustrating the drive mechanism portion thereof.
Figure 7:
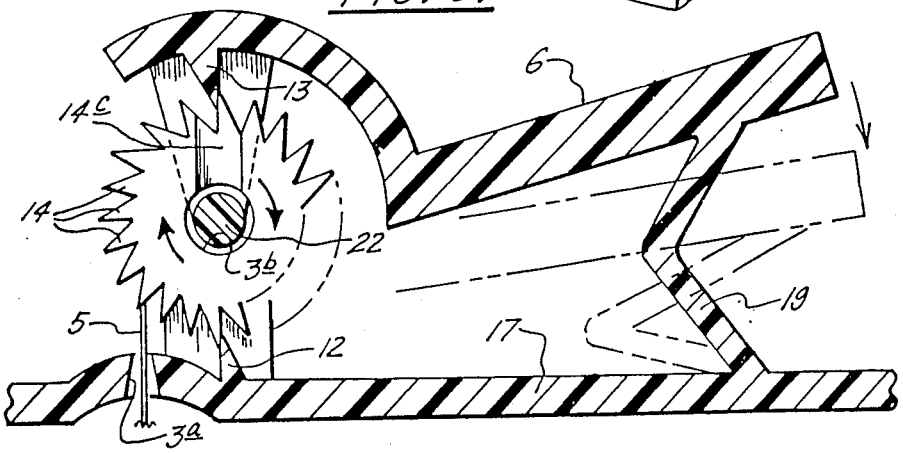
FIG. 7 is a partial sectional, fragmentary view of the prferred embodiment of the apparatus of the present invention illustrating the ratchet mechanism thereof.
Figure 8:
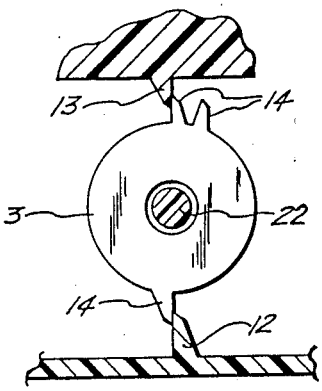
FIG. 8 is a fragmentary view of the preferred embodiment of the apparatus of the present invention.

FIGS. 1–7 illustrate the preferred embodiment of the apparatus of the present invention. In FIG. 1, there can be seen a generally upstanding tubular container 4 having a hollow interior bore which is occupied by a paste product such as toothpaste to be dispensed. Through the center portion of the paste product there is a longitudinally extending cable 5 which attaches at one end portion to follower plate P and at its other end portion to winch drum 3. Container 4 is supported at its lower end portion by multiple gussets 7, each of which is pivotally attached upon the outer wall 4B of container 4 so that each gusset folds into a recess 7A as best illustrated in FIG. 4. This allows the product to be easily stored in a very small container having square dimensions equal to the diameter of container 4. Trigger 6 is depressed by the user as shown by the curved arrow in FIG. 7. This depresses the trigger into the position shown in phantom lines in FIG. 7. A return spring 19 biases trigger 6 to the uppermost position shwon in FIG. 7. It should be understood that trigger 7 can be a one-piece plastic injection molded material such as a plastic having a memory. An examples would be polypropelene plastic. Trigger 6 includes a curved section which carries a transverse tooth 13 that engages a toothed wheel having a plurality of teeth 14 as best seen in FIGS. 6 and 7. Teeth 14 are radially spaced and attached to the outer ends of drum 3 (FIG. 6). The ends of each drum 3 also provide slots 14C which register with side brackets 20 and more particularly with tabs 22 carried by brackets 20. The tabs 22 register with an internal opening 3B which is preferably a cylindrical bore registering with the central axis of cylindrical drum 3. In this manner, the trigger attaches at tabs 20 to drum 3 so that trigger 6 is pivotally attached with respect to drum 3. This pivotal rotation is also seen in FIG. 7 of trigger 6 about bore 3B of drum 3.

Drum 3 is supported by spaced apart brackets 8. One skilled in the art will see that pressure applied to trigger 6 forcing it downwardly toward the position shown in phantom lines in FIG. 7 will produce a corresponding rotation of drum 3. Additionally, when drum 3 rotates, the teeth 14 will engage the transverse tooth 13 of trigger 6 as well as the upwardly extending transverse tooth 12 mounted upon the cover 17 of container 4. This winds cable 5 upon drum 3 and applies tension to cable 5 and an upwardly lift to follower plate P. Continued upward movement of cable 5 and its attached follower plate P creates an internal force which dispenses paste material contained within container 4 and between follower plate P and cover 17 through nozzle N. Nozzle N can be provided with a dispensing cover which is removable, for example. Normally such a dispenser will be a disposable item so that when the cover is removed from the dispensing orifice, it can be discarded or replaced after each use as desired.

In FIG. 5, there can be seen an enlarged view of a single radial tooth 14 of drum 3 as it engages lowermost transverse tooth 12 on container surface 17. Tooth 12 includes a recess ramp section **12*b* and tooth 14 includes a corresponding ramp section 14*b*. The pins 22 loosely fit into bore 3B of drum 3 thus allowing teeth 13 to override teeth 14 on the return stroke. Also teeth 14 are forced against tooth 12 but that force is not overcome since tooth 14 is opposed by the flate surface rather than the ramps 12*b*, 14*b*** coming into contact as in the pump stroke.

The above apparatus can be manufactured of simple, structural material such as plastic injection molded parts. The entire apparatus can be manufactured of very few working parts and thus provides a very simple, inexpensive disposable type dispenser for toothpaste products and the like.

Figure 9:
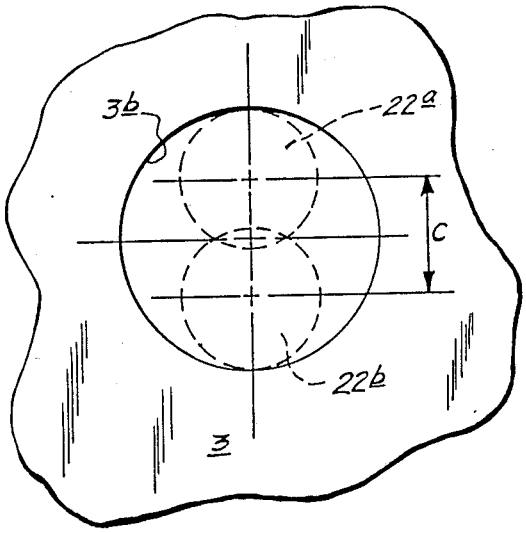
FIG. 9 is a schematic, fragmentary illustration of the preferred embodiment of the apparatus of the present invention illustrating the drum hole portion thereof.

FIG. 9 is a view of drum hole **3*b*. Positions 22*a* and 22*b* of FIG. 9 illustrate the two positions of post 22. The upper position 22*a* indicates the position when the ratchet is released. The lower position 22*b* illustrates when the ratchet is engaged. Dimension "C" is the distance pin 22 travels in FIG. 3 and also the distance tooth 13 travels upward when pump handle is released. This allows more torque on drum 3 and thus teeth 14 to override tooth 12. Legs 19 of the ratchet should have enough spring to return the handle to upper position. As return takes place, tooth 13 overrides teeth 14. The ratchet (in the upper position 22*a*) now moves tooth 13 into 14 with angled surface 13*b* and 14*b* making contact. FIG. 8B** illustrates dimension A and the amount contact of teeth on pump stroke and dimension C of return of ratchet.

Figure 8A:
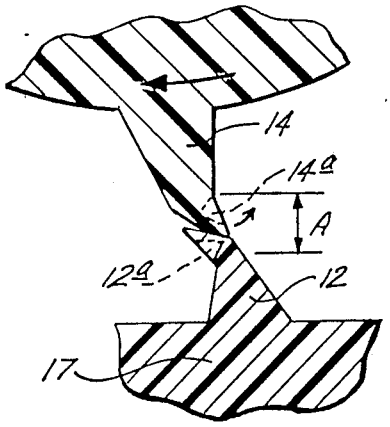
FIGS. 8*a*–8*b* are fragmentary views of the preferred embodiment of the apparatus of the present invention illustrating the ratchet teeth portions thereof.
Figure 8B:
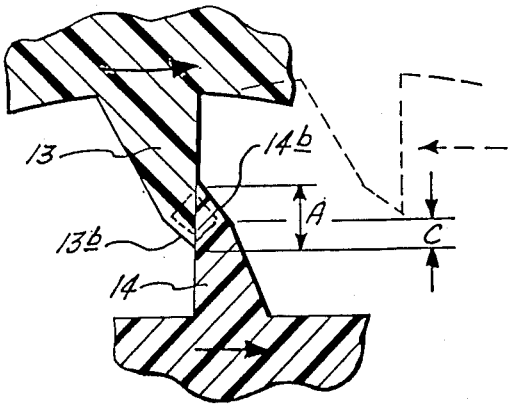

Dimension A of FIG. 8A is equal to "A" of FIG. 8B. This is the key to the ratchet mechanism. In FIG. 8A, recesses **14*a* and 12*a* allow or assist in deflection of the tooth in one direction. This is how teeth 14 override tooth 12 on the pump stroke. On the return stroke, teeth 14 will not override tooth 12 as 12*a* and 14*a* will not aid in deflecting tooth 12. The amount of contact made by tooth 3 as it comes over teeth 14 on the return stroke is now dimension "C" which is less than dimension "A." It may also be noted that tooth 13 could override teeth 14** on the return stroke and not touch any of the teeth.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. A paste dispenser comprising:

(a) an elongated tubular body having a continuous side wall defining a central bore for containing a paste product therein with a dispensing outlet positioned at one end portion of the tube;

(b) a follower plate movably disposed within the bore of the tubular body at one end portion thereof, defining an end portion for containing paste contained within the tube, the initial position of the plate being at an opposite end of the tube from the outlet when the tube is filled with paste;

(c) a transverse plate positioned at the end portion of the tubular body adjacent the outlet closing one end of the bore by communicating at its periphery with the side wall;

(d) a rotatable drum mounted on the tubular body upon the transverse plate;

(e) a pivotally moving support mounted at least in part inside the continuous wall at one end portion of the tubular body and connected to the drum for rotating said drum and providing a gripping surface which can be manually forced to move the pivot between first and second positions which rotates the drum;

(f) biasing means for urging the pivot to assume the first position;

(g) ratchet means on the pivotaly moving support and drum for urging a rotation of the drum in one rotational direction; and (h) an elongated length of cable attached at one end portion to the follower plate and at its other end portion to the drum so that rotation of the drum winds the cable thereupon, applying tension to the cable for urging the follower plate towards the transverse plate.

2. The apparatus of claim 1 wherein the pivot means is trigger which is pivotally mounted to the tube upon the transverse plate.

3. The apparatus of claim 1 wherein the biasing means includes a spring mechanism attached to the pivot means.

4. The apparatus of claim 1 wherein the drum and transverse plate further provides ratchet means for preventing rotation of the drum in one direction.

5. The apparatus of claim 4 wherein the transverse plate carries at least one toothed portion that cooperates with a plurality of teeth radially spaced upon the drum.

6. The apparatus of claim 1 wherein the followr plate and cable are of a plastic construction.

* * * * *